US010515612B2

(12) United States Patent
Mobasher et al.

(10) Patent No.: US 10,515,612 B2
(45) Date of Patent: Dec. 24, 2019

(54) TRANSFORMATION BASED STRESS PROFILE COMPRESSION

(71) Applicant: Samsung Display Co., Ltd., Yongin-si, Gyeonggi-do (KR)

(72) Inventors: Amin Mobasher, San Jose, CA (US); Shiva Moballegh, Campbell, CA (US); Jalil Kamali, San Jose, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 42 days.

(21) Appl. No.: 15/983,014

(22) Filed: May 17, 2018

(65) Prior Publication Data

US 2019/0295510 A1 Sep. 26, 2019

Related U.S. Application Data

(60) Provisional application No. 62/648,310, filed on Mar. 26, 2018.

(51) Int. Cl.

| | |
|---|---|
| ***G09G 5/39*** | (2006.01) |
| ***G09G 5/393*** | (2006.01) |
| ***G09G 3/3208*** | (2016.01) |

(52) U.S. Cl.

CPC ..... *G09G 5/393* (2013.01); *G09G 3/3208* (2013.01); *G09G 2320/0233* (2013.01); *G09G 2320/0257* (2013.01); *G09G 2320/0295* (2013.01); *G09G 2320/045* (2013.01)

(58) Field of Classification Search

CPC ..... G09G 5/393; G09G 3/3208; G09G 2320/043; G09G 2320/0233

USPC ..... 345/555

See application file for complete search history.

(56) References Cited

U.S. PATENT DOCUMENTS

| | | | | |
|---|---|---|---|---|
| 7,619,596 | B2 | 11/2009 | Tada | |
| 9,697,765 | B2 | 7/2017 | Chung et al. | |
| 9,773,455 | B2 | 9/2017 | Chung et al. | |
| 9,812,067 | B2 | 11/2017 | Yang et al. | |
| 2010/0257493 | A1* | 10/2010 | Agarwal | G06F 17/5036 716/136 |
| 2012/0147799 | A1* | 6/2012 | Nagara | H04N 21/4122 370/310 |
| 2014/0168192 | A1 | 6/2014 | Jeong et al. | |
| 2014/0176409 | A1 | 6/2014 | Kim et al. | |
| 2015/0243201 | A1* | 8/2015 | Chung | G09G 3/3225 345/690 |
| 2016/0372033 | A1 | 12/2016 | Yoo | |
| 2016/0373788 | A1* | 12/2016 | Gamei | H04N 19/61 |

* cited by examiner

*Primary Examiner* — Thomas J Lett

(74) *Attorney, Agent, or Firm* — Lewis Roca Rothgerber Christie LLP

(57) ABSTRACT

A system and method for operating a display. In some embodiments, the method includes: transforming a stress profile for a slice of the display, with a first transformation, to form a transformed stress profile; compressing the transformed stress profile to form a compressed transformed stress profile; decompressing the compressed stress profile to form a decompressed transformed stress profile; and transforming the decompressed transformed stress profile, with a second transformation, to form a decompressed stress profile, the second transformation being an inverse of the first transformation.

20 Claims, 11 Drawing Sheets

$$F = \frac{1}{\sqrt{N}} \begin{bmatrix} 1 & 1 & 1 & 1 & \cdots & 1 \\ 1 & \omega & \omega^2 & \omega^3 & \cdots & \omega^{N-1} \\ 1 & \omega^2 & \omega^4 & \omega^6 & \cdots & \omega^{2(N-1)} \\ 1 & \omega^3 & \omega^6 & \omega^9 & \cdots & \omega^{3(N-1)} \\ \vdots & \vdots & \vdots & \vdots & \ddots & \vdots \\ 1 & \omega^{N-1} & \omega^{2(N-1)} & \omega^{3(N-1)} & \cdots & \omega^{(N-1)(N-1)} \end{bmatrix}$$

$$w = e^{-2\pi i/N}$$

*FIG. 7*

$$\boldsymbol{F} = \frac{1}{\sqrt{N}} \boldsymbol{H}_{2^k}$$

where $N = 2^k$ $$H_1 = [1],$$

$$H_2 = \begin{bmatrix} 1 & 1 \\ 1 & -1 \end{bmatrix},$$

and $$H_{2^k} = \begin{bmatrix} H_{2^{k-1}} & H_{2^{k-1}} \\ H_{2^{k-1}} & -H_{2^{k-1}} \end{bmatrix} = H_2 \otimes H_{2^{k-1}}.$$

*FIG. 8*

- $\boldsymbol{F} = \frac{1}{\sqrt{N/2}} \boldsymbol{U}_{2^n}, \boldsymbol{F}^{-1} = \frac{1}{\sqrt{N/2}} \boldsymbol{U}_{2^n}^{-1}, N = 2^n$ where $$\mathbf{U}_{2^n} = \begin{bmatrix} \mathbf{U}_{2^{n-1}} & 0 \\ \mathbf{U}_{2^{n-1}} & \mathbf{U}_{2^{n-1}} \end{bmatrix} \quad \text{and} \quad \mathbf{U}_{2^n}^{-1} = \begin{bmatrix} \mathbf{U}_{2^{n-1}} & 0 \\ -\mathbf{U}_{2^{n-1}} & \mathbf{U}_{2^{n-1}} \end{bmatrix}$$

$$\mathbf{U}_1 = \mathbf{U}_1^{-1} = [1]$$

*FIG. 10*

$$\boldsymbol{F}^{-1} = \boldsymbol{H}'_{2^n} \text{ or } \boldsymbol{F}^{-1} = \boldsymbol{U}_{2^n}^{-1}$$

$$\boldsymbol{F} = \frac{1}{N}\boldsymbol{H}_{2^n} \text{ or } \boldsymbol{F} = \frac{1}{N}\boldsymbol{U}_{2^n}^{-1}$$

where $N = 2^n$

*FIG. 11*

TRANSFORMATION BASED STRESS PROFILE COMPRESSION

CROSS-REFERENCE TO RELATED APPLICATION(S)

The present application claims priority to and the benefit of U.S. Provisional Application No. 62/648,310, filed Mar. 26, 2018, entitled "TRANSFORMATION BASED STRESS PROFILE COMPRESSION", the entire content of which is incorporated herein by reference.

FIELD

One or more aspects of embodiments according to the present disclosure relate to stress compensation in a display, and more particularly to a system and method for mitigating the effects of truncation errors when employing compressed storage of stress profiles.

BACKGROUND

Compensation for output decline in a video display such as an organic light-emitting diode (OLED) display may be used to preserve image quality as a display ages. The data used to perform such compensation may be stored in compressed form to reduce memory requirements; however, errors in such compressed data may accumulate unevenly resulting in loss of image quality.

Thus, there is a need for an improved system and method for stress compensation.

SUMMARY

According to an embodiment of the present disclosure there is provided a method for operating a display, the method including: transforming a stress profile for a slice of the display, with a first transformation, to form a transformed stress profile; compressing the transformed stress profile to form a compressed transformed stress profile; decompressing the compressed transformed stress profile to form a decompressed transformed stress profile; and transforming the decompressed transformed stress profile, with a second transformation, to form a decompressed stress profile, the second transformation being an inverse of the first transformation.

In one embodiment, the transforming of the stress profile, with a first transformation, includes multiplying the stress profile by a first transformation matrix.

In one embodiment, the first transformation matrix is a discrete Fourier transform matrix.

In one embodiment, the first transformation matrix is a Hadamard matrix.

In one embodiment, the first transformation matrix is a unimodular matrix.

In one embodiment, the method includes generating a number, wherein the first transformation matrix is: a first matrix, when the number equals a first value, and a second matrix, different from the first matrix, when the number equals a second value.

In one embodiment, the second matrix is an identity matrix.

In one embodiment, the number is a pseudorandom number.

In one embodiment, the method includes: storing the compressed transformed stress profile in a memory, and storing the number in the memory.

According to an embodiment of the present disclosure there is provided a system for performing stress compensation in a display, the system including: a memory; and a processing circuit configured to: transform a stress profile for a slice of the display, with a first transformation, to form a transformed stress profile; compress the transformed stress profile to form a compressed transformed stress profile; decompress the compressed transformed stress profile to form a decompressed transformed stress profile; and transform the decompressed transformed stress profile, with a second transformation, to form a decompressed stress profile, the second transformation being an inverse of the first transformation.

In one embodiment, the transforming of the stress profile, with a first transformation, includes multiplying the stress profile by a first transformation matrix.

In one embodiment, the first transformation matrix is a discrete Fourier transform matrix.

In one embodiment, the first transformation matrix is a Hadamard matrix.

In one embodiment, the first transformation matrix is a unimodular matrix.

In one embodiment, the processing circuit is further configured to generate a number, and the first transformation matrix is: a first matrix, when the number equals a first value, and a second matrix, different from the first matrix, when the number equals a second value.

In one embodiment, the second matrix is an identity matrix.

In one embodiment, the number is a pseudorandom number.

In one embodiment, the processing circuit is further configured to: store the compressed transformed stress profile in the memory, and store the number in the memory.

According to an embodiment of the present disclosure there is provided a display, including: a display panel; a memory; and a processing circuit configured to: transform a stress profile for a slice of the display, with a first transformation, to form a transformed stress profile; compress the transformed stress profile to form a compressed transformed stress profile; decompress the compressed transformed stress profile to form a decompressed transformed stress profile; and transform the decompressed transformed stress profile, with a second transformation, to form a decompressed stress profile, the second transformation being an inverse of the first transformation.

In one embodiment, the first transformation is a discrete Fourier transform.

BRIEF DESCRIPTION OF THE DRAWINGS

These and other features and advantages of the present disclosure will be appreciated and understood with reference to the specification, claims, and appended drawings wherein:

FIG. 7 is a set of equations for a transformation, according to an embodiment of the present disclosure;

FIG. 8 is a set of equations for a transformation, according to an embodiment of the present disclosure;

FIG. 10 is a set of equations for a transformation, according to an embodiment of the present disclosure; and FIG. 11 is a set of equations for a transformation, according to an embodiment of the present disclosure.

DETAILED DESCRIPTION

The detailed description set forth below in connection with the appended drawings is intended as a description of exemplary embodiments of a system and method for transformation based stress profile compression provided in accordance with the present disclosure and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the scope of the disclosure. As denoted elsewhere herein, like element numbers are intended to indicate like elements or features.

Certain kinds of video displays may have characteristics that change with use. For example, an organic light-emitting diode (OLED) display may include a display panel having a plurality of pixels, each consisting of several subpixels (e.g., a red subpixel, a green subpixel, and a blue subpixel), and each of the subpixels may include an organic light-emitting diode configured to emit a different respective color. Each organic light-emitting diode may have an optical efficiency that declines with use, so that, for example, after the organic light-emitting diode has been in operation for some time, the optical output at a certain current may be lower than it was, at the same current, when the organic light-emitting diode was new.

This reduction in optical efficiency may result in dimming of parts of a display panel that have on average, during the life of the display, displayed brighter portions of the displayed images than other parts of the display. For example, a display used to view largely unchanging images from a security camera, the field of view of which contains a scene having a first portion which is sunlit, and relatively bright, during most of the day, and a second portion which is in the shade and relatively dim, during most of the day, may eventually show a more significant decrease in optical efficiency in the first portion than in the second portion. The fidelity of image reproduction of such a display may degrade over time as a result. As another example, a display that is used part of the time to display white text at the bottom of the image, separated by a black margin from the rest of the image, may experience a lower reduction of optical efficiency in the black margin than in other parts of the display panel, so that if the display is later used in a mode in which a scene fills the entire display panel, a brighter band may appear where the black margin was previously displayed (image sticking).

Figure 1:
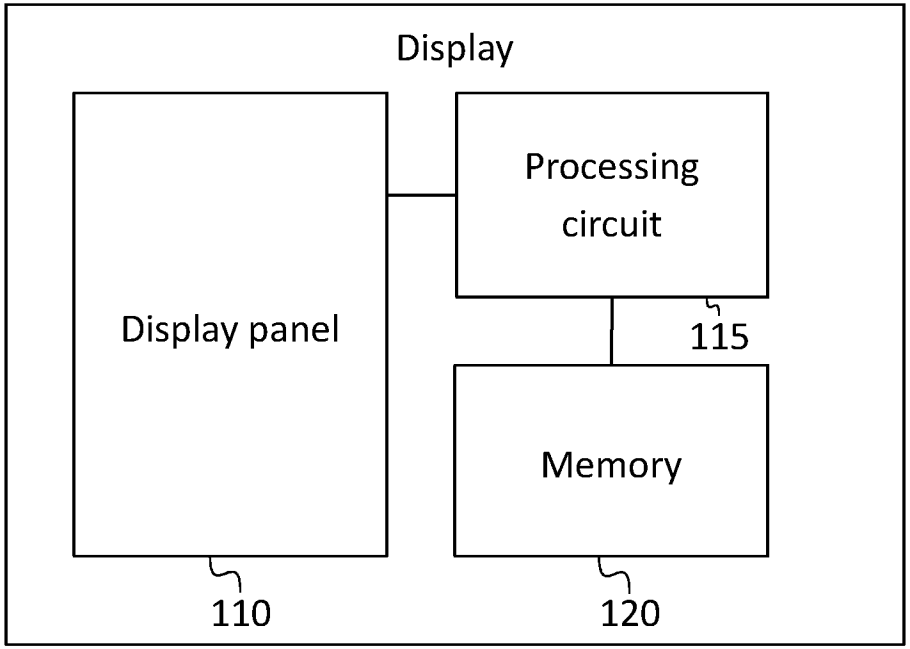
FIG. 1 is a block diagram of a display, according to an embodiment of the present disclosure.

To reduce the effect of such non-uniformities in the optical efficiency of a display, a display may include features to compensate for the reduction of optical efficiency resulting from use of the display. Referring to FIG. 1, such a display may include the display panel 110, a processing circuit 115 (discussed in further detail below), and a memory 120. The contents of the memory, which may be referred to as a "stress profile" or "stress table" for the display, may be a table of numbers (or "stress values") indicating (or from which may be inferred) the amount of stress each sub-pixel has been subjected to during the life of the display. The "stress" may be the total (time-integrated) drive current that has flowed through the sub-pixel during the life of the display, i.e., the total charge that has flowed through the sub-pixel during the life of the display. For example, the memory may accumulate one number for each sub-pixel; each time a new image is displayed, e.g., as part of a continuous stream of images together forming displayed video (or less frequently, as described below, to reduce the burden on the stress compensation system), the drive current for each sub-pixel in the image may be measured and a number indicating the current or brightness of the subpixel may be added to the respective number for that sub-pixel in the memory. In a display having a timing controller and a plurality of driver integrated circuits, the processing circuit may be, or may be part of, one or more of the driver integrated circuits. In some embodiments, each driver integrated circuit is responsible for driving a portion of the display panel, and it may accordingly perform stress tracking and stress compensation for that portion, independently of the other driver integrated circuits.

During operation, the drive current to each sub-pixel may be adjusted to compensate for an estimated loss of optical efficiency, the estimated loss of optical efficiency being based on the lifetime stress of the sub-pixel. For example the drive current to each sub-pixel may be increased in accordance with (e.g., in proportion to) the estimated loss of optical efficiency of the sub-pixel accumulated in the memory, so that the optical output may be substantially the same as it would have been had the optical efficiency of the sub-pixel not been reduced, and had the drive current not been increased. A non-linear function based on empirical data or a model of the physics of the sub-pixel may be used to infer or predict the loss of optical efficiency expected to be present, based on the lifetime stress of the sub-pixel. The calculations of the predicted loss of optical efficiency, and of the accordingly adjusted drive current, may be performed by the processing circuit.

Figure 2:
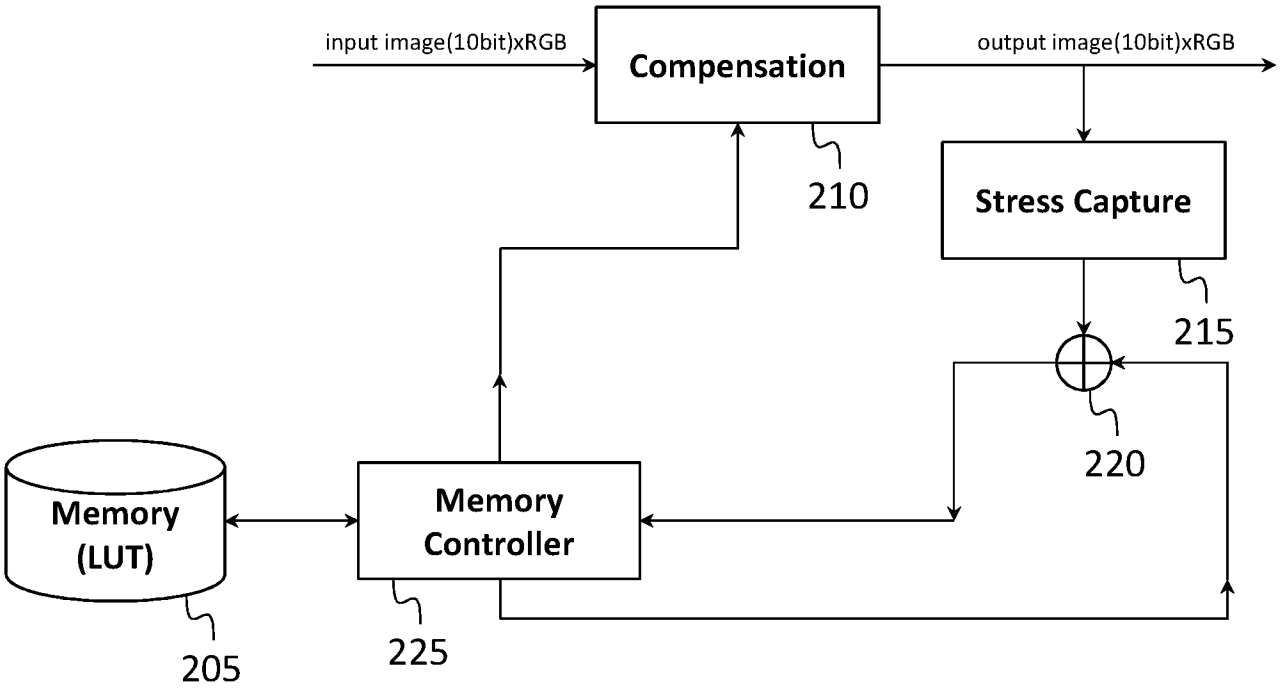
FIG. 2 is a block diagram of a system for stress compensation without compression, according to an embodiment of the present disclosure.

FIG. 2 shows a block diagram of a system for stress compensation. The stress table is stored in the memory 205. In operation, stress values are read out of the stress table and used by a drive current adjustment circuit 210 ("Compensation" block), to calculate adjusted drive current values, each adjusted drive current value being a raw drive current value (based on the desired optical output of the sub-pixel), adjusted according to the accumulated stress of the sub-pixel. The adjusted drive current values (which represent the current rate of accumulation of stress of the sub-pixels being displayed) are read by a sub-pixel stress sampling circuit 215 ("Stress Capture" block) and each previously stored stress value is increased (or "augmented"), in an adding circuit 220, by the current rate of accumulation of stress (i.e., by a number proportional to the adjusted drive current value), and saved back to the memory 205. A memory controller 225 controls read and write operations in the memory, feeds the stress values from the memory to the drive current adjustment circuit 210 and to the adding circuit 220 as needed, and stores the augmented stress values (having been augmented by the addition of the current rate of accumulation of stress) back into memory.

Tracking the total stress of each sub-pixel may require a significant amount of memory. For example, for a display with 1920×1080 pixels, with three sub-pixels per pixel, and with the stress of each sub-pixel stored as a 4-byte (32-bit) number, the size of the memory required may be approximately 25 megabytes. Moreover, the computational burden of updating each stress number for each frame of video (i.e., for each displayed image) may be significant.

Various approaches may be used to reduce the burden of tracking, and correcting for the reduction in optical efficiency resulting from, sub-pixel stress. For example, the sub-pixel stress sampling circuit 215 may sample only a subset of the adjusted drive current values in each image (i.e., in each frame of video). For example, in a display having 1080 lines (or rows) of pixels, in some embodiments only one row of the stress table is updated per frame of video. The discarding of the intervening 1079 adjusted drive current values, between pairs of adjusted drive current values that are taken into account, for any sub-pixel may result in only a small, acceptable loss of accuracy in the resulting stress values (as a measure of the lifetime stress of the sub-pixel) if, for example, the scene changes relatively slowly in the video being displayed.

In another embodiment, the sub-pixel stress sampling circuit 215 may in addition sample only at subset of frames. For example, in a display having 1080 lines (or rows) with refresh rate of 60 Hz (showing 60 frames per minute), the stress sampling circuit 215 samples all or partial drive current values in the image once every 10 frames and the stress table is updated accordingly.

Figure 3:
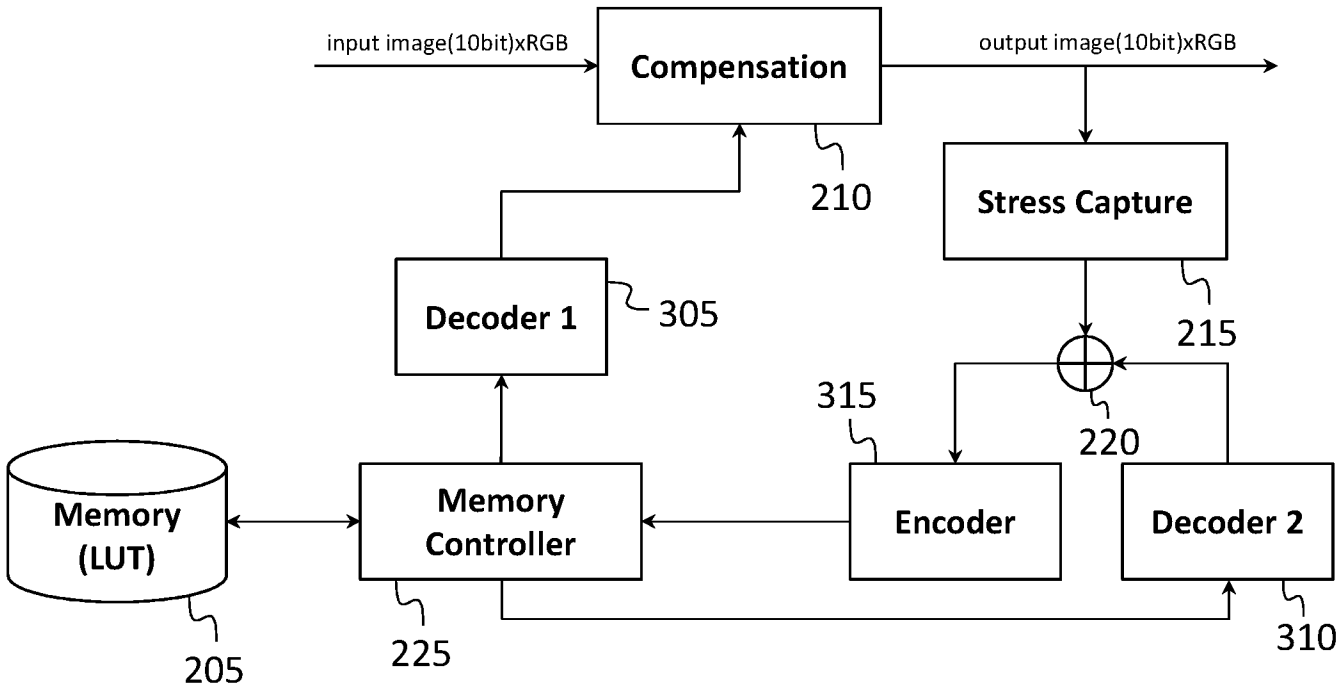
FIG. 3 is a block diagram of a system for stress compensation with compression, according to an embodiment of the present disclosure.

Various approaches may also be used to reduce the memory size required for storing sub-pixel stress in the stress table. For example the memory on the stress profile chipset may be reduced by compressing the data stored in the memory. Referring to FIG. 3, in some embodiments, a compressed representation of the stress table is stored in the memory 205; the compressed stress data are decompressed by a first decoder 305 before being fed to the drive current adjustment circuit 210. The compressed stress data are decompressed by a second decoder 310 before being sent to the adding circuit 220, and the augmented stress values are encoded, or compressed, by an encoder 315, before being stored in the memory 205. The encoder 315 encodes data that it receives in a manner that compresses it, and each of the first decoder 305 and the second decoder 310 performs an operation that inverts, or approximately inverts, the operation performed by the encoder 315, i.e., each of the first decoder 305 and the second decoder 310 decompresses data that it receives. Accordingly, "coding" and "compressing" (and related words, such as "encoding" and "encoded", and "compressed", respectively) are used interchangeably herein, as are "decoding" and "decompressing" (and related words, such as "decoded" and "unencoded", and "decompressed" and "uncompressed", respectively). Various methods of compression may be employed, including entropy coding, such as Huffman coding or arithmetic coding.

Figure 4:
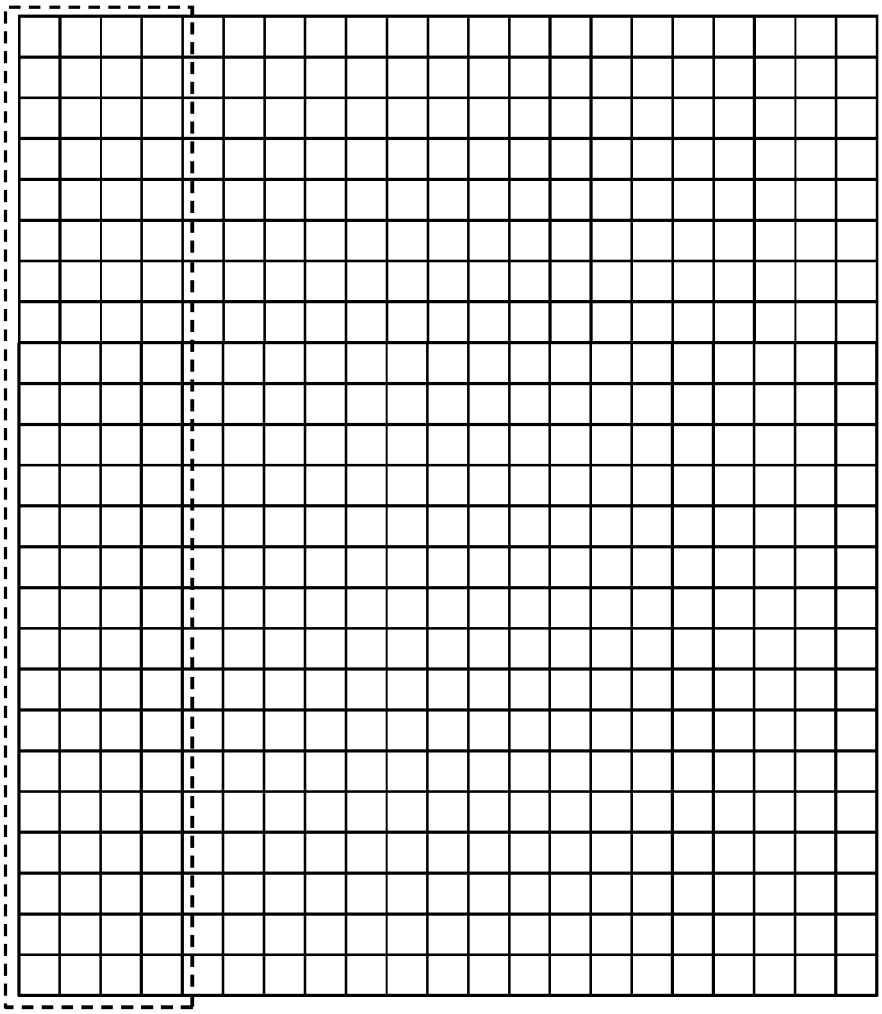
FIG. 4 is a schematic drawing of a portion of an image, according to an embodiment of the present disclosure.

Stress table data may be encoded and decoded in blocks referred to herein as "slices", each of which may in general be in arbitrary subset of the stress table. In some embodiments each slice corresponds to a square or rectangular region of the stress table, and to a square or rectangular region of the display panel. The square or rectangular region of the display panel may be referred to as a slice of the display, and the corresponding slice of the stress table data may be referred to as the stress profile of the slice of the display. Unless otherwise specified, a "slice", as used herein, refers to a slice of the stress profile. The horizontal dimension of the region of the display panel to which a slice corresponds may be referred to as the "slice width" and the vertical dimension may be referred to as the "line dimension". For example, as illustrated in FIG. 4, a slice may correspond to 4 lines and 24 columns of the display, i.e., it may have a slice width of 24 and a line dimension of 4.

The size of the region of memory allocated to storing the compressed representation of each slice may be fixed or variable based on the compression algorithm used. In one embodiment it can be fixed and selected based on an estimated compression ratio for the coding method used. The compression ratio achieved in operation may vary, however, depending on, for example, the extent to which symbols are repeated in the uncompressed data. When the compression ratio achieved in operation is not sufficiently high to allow the compressed slice to fit within the region of memory allocated to storing the compressed representation of the slice, the raw data may be truncated (i.e., one or more of the least-significant bits of each data word may be removed) before compression is performed, to reduce the size, in memory, of the compressed representation of the slice, so that it will fit within the region of memory allocated to storing the compressed representation of the slice. In another embodiment, the required memory length can be calculated to cover the worst case scenario. In another embodiment, the length of compressed representation can be variable and it is stored in a Table or it is appended to the compressed data.

Figure 5:
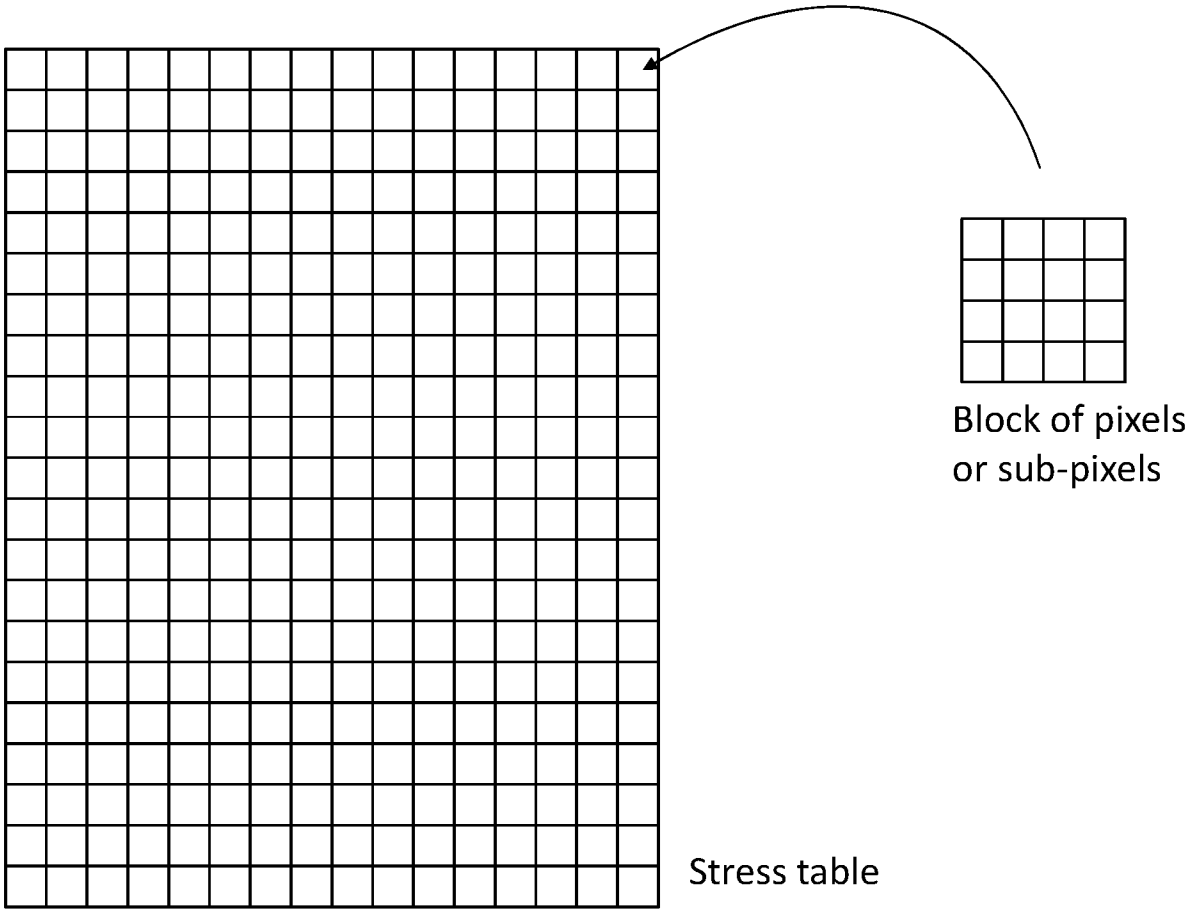
FIG. 5 is a schematic drawing of a portion of a stress table, according to an embodiment of the present disclosure.

The burden of tracking, and correcting for, sub-pixel stress may also (or instead) be reduced by averaging the data stored in the memory. For example, as illustrated in FIG. 5, in some embodiments each entry in the stress table, instead of representing the accumulated stress of a single sub-pixel, represents a function of the respective stresses experienced by a block (e.g., a 4×4 block, as shown) of pixels or sub-pixels. For example, the stress table entry storing the data for a 4×4 block may store the average, over the 4×4 block, of the luminance values of the pixels, or it may store the average of the components (i.e., the average of the stress of all of the 48 sub-pixels in the 4×4 block, or three elements of the stress table may store respective averages, over the 4×4 block, of the red, green, and blue pixels in the 4×4 block.

A decompressed representation of a slice of the stress table (after compression and decompression) may differ from the uncompressed representation of the slice (before being compressed), due to compression and decompression errors, for example, if a lossy compression is used or if truncation is performed, as described above, then, even if a lossless compression method (such as Huffman coding or arithmetic coding) is employed. If the stress data of a slice are decompressed before being augmented and then compressed again in the same manner each time the stress data are augmented with newly sampled adjusted drive current values, then such discrepancies may accumulate disproportionately in some data words. Accordingly, it may be advantageous to employ measures to counter such uneven accumulation of errors due to truncation, to reduce the likelihood that the accumulated errors will cause unacceptable or overcompensation of image quality.

Figure 6:
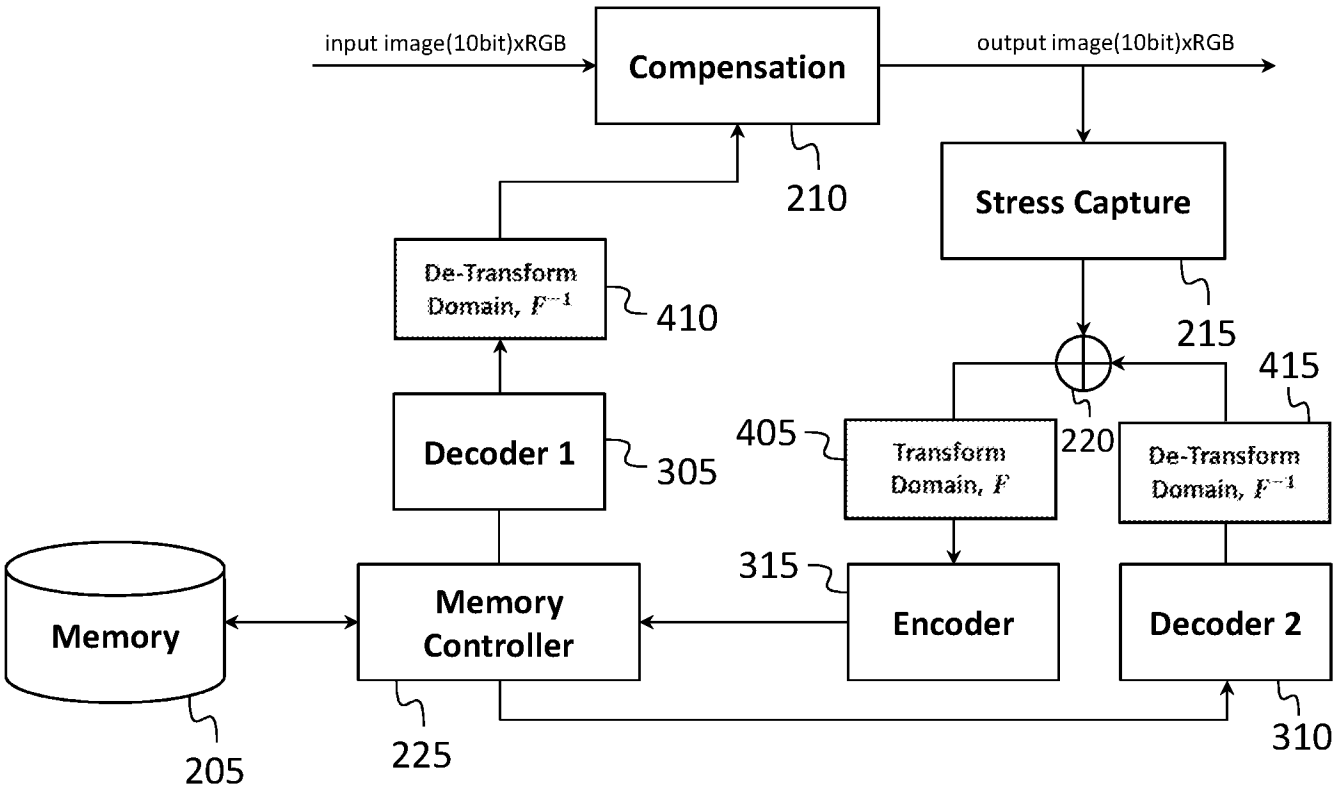
FIG. 6 is a block diagram of a system for stress compensation with compression, according to an embodiment of the present disclosure.

In some embodiments, transformations are employed to distribute the compression errors within the slices, and to avoid an accumulation of such errors in a value, or in a small number of values, in each slice. FIG. 6 shows a block diagram for implementing this method, in some embodiments. A slice transformation circuit 405 applies a first (or "forward") transformation to the stress data of a slice before the slice is encoded by the encoder 315. After any compressed slice is decoded by the first decoder 305, a first slice de-transformation circuit 410 applies a second transformation to the output of the first decoder 305, the second transformation being an inverse of the first transformation so that the output of the first slice de-transformation circuit 410 is the same as, or nearly the same as (differing, for example, by discrepancies resulting from truncation, as discussed above), the uncompressed slice data that were processed by the slice transformation circuit 405 and by the encoder 315 to form the compressed slice. Similarly, after any compressed slice is decoded by the second decoder 310, a second slice de-transformation circuit 415 applies the second transformation to the output of the second decoder 310, so that the output of the second slice de-transformation circuit 415 is the same as, or nearly the same as, the uncompressed slice data that were processed by the slice transformation circuit 405 and by the encoder 315 to form the compressed slice.

In some embodiments, permutations are also employed to distribute the compression errors within the slices. A first permutation may be applied to the stress data of the slice before the forward transformation is applied, and a second permutation may be applied after the second transformation is applied, the second permutation being an inverse of the first permutation. The first permutation may be, for example, a circular shift, an up-down switch of the order of elements in the slice, or a left-right switch of the elements in the slice. In some embodiments the first permutation is instead applied to the stress data of the slice after the forward transformation is applied, and the second permutation is applied before the second transformation is applied.

Various transformations may be employed. In some embodiments, one or more transformations are performed by multiplying the input data (e.g., the untransformed slice, if the first, or forward transformation is being applied, or the transformed slice, if the second, or inverse transformation is being applied) by a matrix. Prior to performing this matrix multiplication, the slice data, which may be conceptually in the form of a rectangular array, may be re-formatted into a vector, e.g., by concatenating the rows or columns of the rectangular array. In practice, this operation may be conceptual only since the elements of the (rectangular) slice array may in any event be stored in "vector" format, in a sequence of consecutive memory locations in a memory of the processing circuit.

Suitable transformation and inverse transformation pairs may include (i) a fast Fourier transform (FFT) and its inverse (IFFT), the matrix for which may be the complex conjugate of the fast Fourier transform matrix, (ii) a discrete Fourier transform (DFT) and its inverse (IDFT), the matrix for which may be the complex conjugate of the discrete Fourier transform matrix, (iii) a transformation based on a Hadamard matrix, the inverse of which may be the transpose of the Hadamard matrix, (iv) a transformation based on a unimodular matrix, and an inverse transformation based on the inverse of the unimodular matrix, and (v) a transformation based on a single carrier matrix, and an inverse transformation based on the inverse of the single carrier matrix (the single carrier matrix may be formed as the product of a discrete Fourier transform matrix and an inverse fast Fourier transform matrix).

In operation, a different transformation may be used on different occasions that a slice is encoded, and the inverse transformation may then be used when the slice is subsequently decoded. For example, each time a slice is encoded a number may be generated (e.g., by a counter or by a pseudorandom number generator) and a transformation may be selected, from a list of transformations, based on the number. The list of transformations may include the identity transformation (which corresponds to leaving the slice unchanged, and may be represented by an identity matrix). In some embodiments, the number identifying the transformation used is stored in the memory 205 along with the encoded slice and retrieved (and used to identify the appropriate inverse transformation) when the encoded slice is retrieved for decoding. In other embodiments a second number generator, which is a copy of the first number generator (the second number generator being initialized to generate numbers suitably offset in time), is used to generate, again, at the time of decoding any encoded slice, the number that the first number generator generated at the time of the encoding of the slice. In some embodiments, on each pass through the stress table, the same transformation is used for each slice; in other embodiments, on each pass through the stress table, different transformations are used from one slice to the next.

When a fast Fourier transform/detransform or discrete Fourier transform/detransform is used, the transformation may be performed as a sequence of approximate matrix products, each approximate matrix product consisting of (i) a floating point or fixed-point matrix product of (1) a row, of the transformation matrix, which may be a vector of complex fixed point or floating point numbers and (2) the slice, which may be a vector of integers, and (ii) truncation (i.e., discarding) of the fractional part, so that only the integer part is preserved as the approximate dot product. A suitable transformation matrix for a discrete Fourier transform is defined by the two equations of FIG. 7.

FIG. 8 shows equations defining a general Hadamard matrix, which, as mentioned above, may be among the transformations employed. In the last equation of FIG. 8, the circle-x operator represents a Kronecker product. As described above for the case of a fast Fourier transform or discrete Fourier transform, fractional parts may be truncated in the matrix product of the Hadamard transformation or detransformation matrix with the slice.

Figure 9:
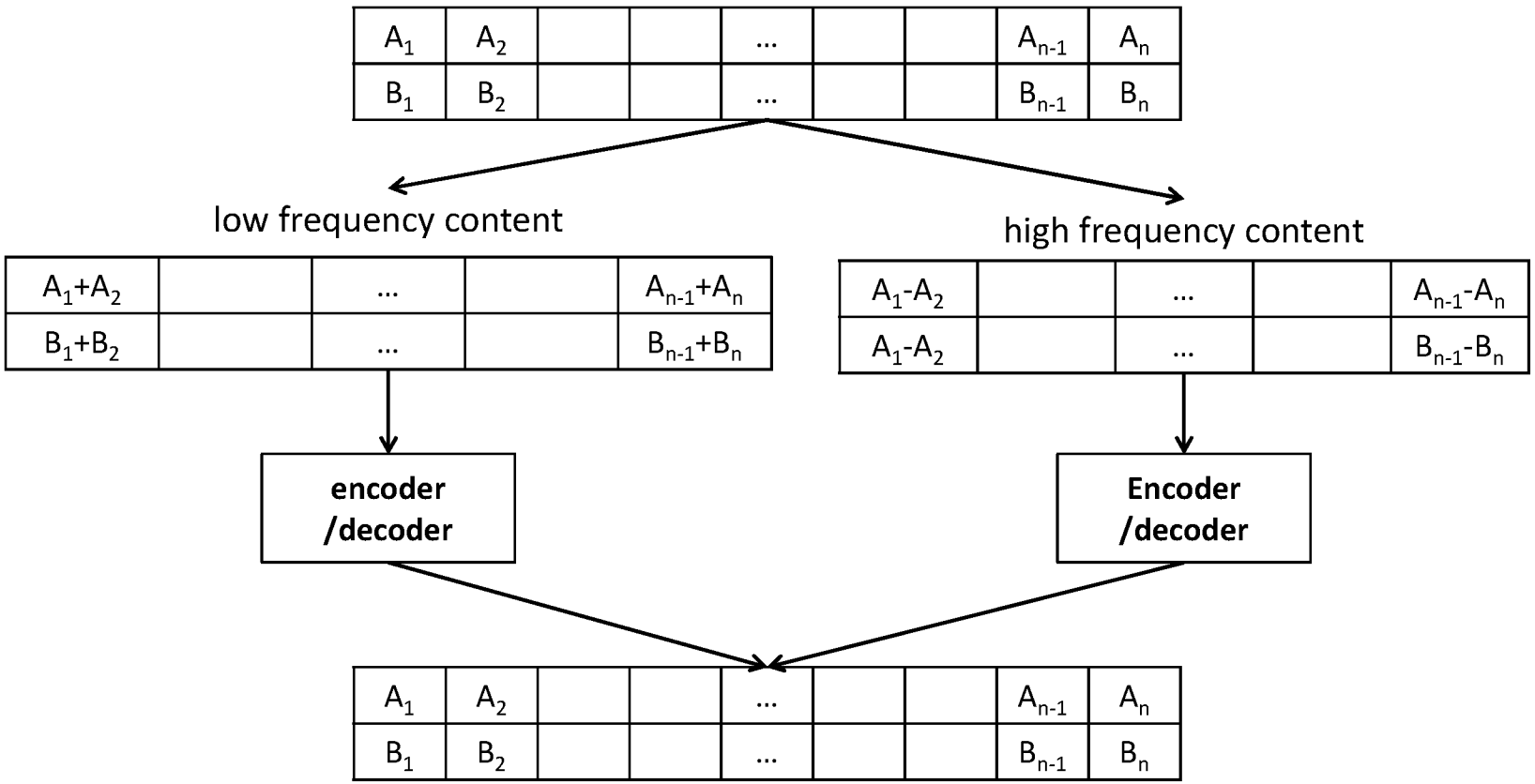
FIG. 9 is a data flow diagram, according to an embodiment of the present disclosure.

Referring to FIG. 9, in some embodiments a slice is converted to two slices, each having half as many columns or rows as the slice. In one embodiment, it can be: (i) a slice with low frequency content of the slice, in which each column (or row) is the sum of two adjacent columns (or row) of the slice and (ii) a slice with high frequency content of the slice, in which each column (or row) is the difference between two adjacent columns (or rows) of the slice. The low frequency slice and the high frequency slice may then be separately encoded and the results concatenated to form the compressed transformed stress profile of the slice. To invert this set of operations for decoding, the compressed transformed stress profile may be split (i.e., de-concatenated) into the two compressed slices, each of which may be decoded, to form the decompressed low frequency slice and the decompressed high frequency slice, respectively, which may be suitably combined to produce the uncompressed slice (e.g., the first column (or row) of the slice being one half of the sum of the first column (or row) of the low frequency matrix and the first column (or row) of the high frequency matrix, the second column (or row) of the slice being one half of the difference between the first column (or row) of the low frequency matrix and the first column (or row) of the high frequency matrix, and so forth).

In some embodiments, as mentioned above, the transformation matrix may be a unimodular matrix, i.e., a square integer matrix having determinant +1 or −1, or, equivalently, an integer matrix that is invertible over the integers. The equations of FIG. 10 define (recursively) a sequence of unimodular matrices of increasing dimension, in one embodiment.

In some embodiments, discarding the fractional parts when performing the matrix multiplications used to implement the transformations and inverse transformations may introduce errors (e.g., small rounding errors) into the stress profile. These errors may be reduced by using higher precision in some operations, e.g., by using inverse transformation matrices multiplied by a scale factor greater than one (and transformation matrices divided by the same scale factor, so that the product of any transformation matrix and the transformation matrix of its inverse remains the identity matrix), so that the discarding of the fractional part of each element of the matrix product results in a smaller fractional error. For example, using the equations of FIG. 11 may produce numbers, at both the input and the output of the adding circuit 220 (FIG. 6) that are larger by n bits, and in which the error introduced by discarding the fractional portion is smaller by a factor of N. In specific, in FIG. 11, the transformation matrix has a division by N (compared to $$\frac{1}{\sqrt{N}}$$

before) and detransformation matrix doesn't have any scalar division. This approach may involve the use of circuits capable of handling larger numbers in the slice transformation circuit 405 (FIG. 6), the adding circuit 220, and the second slice de-transformation circuit 415, but the size of the numbers stored in the memory 205 may remain the same (and, accordingly, it may not be necessary to increase the size of the memory 205).

The term "processing circuit" is used herein to mean any combination of hardware, firmware, and software, employed to process data or digital signals. Processing circuit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In a processing circuit, as used herein, each function is performed either by hardware configured, i.e., hard-wired, to perform that function, or by more general purpose hardware, such as a CPU, configured to execute instructions stored in a non-transitory storage medium. A processing circuit may be fabricated on a single printed circuit board (PCB) or distributed over several interconnected PCBs. A processing circuit may contain other processing circuits; for example a processing circuit may include two processing circuits, an FPGA and a CPU, interconnected on a PCB.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art. As used herein, the term "major component" refers to a component that is present in a composition, polymer, or product in an amount greater than an amount of any other single component in the composition or product. In contrast, the term "primary component" refers to a component that makes up at least 50% by weight or more of the composition, polymer, or product. As used herein, the term "major portion", when applied to a plurality of items, means at least half of the items.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a transformation based stress profile compression have been specifically described and illustrated herein, many modifications and variations will be apparent to those skilled in the art. Accordingly, it is to be understood that a transformation based stress profile compression constructed according to principles of this disclosure may be embodied other than as specifically described herein. The invention is also defined in the following claims, and equivalents thereof.

What is claimed is:

1. A method for operating a display, the method comprising:

transforming a stress profile for a slice of the display, with a first transformation, to form a transformed stress profile;

compressing the transformed stress profile to form a compressed transformed stress profile;

decompressing the compressed transformed stress profile to form a decompressed transformed stress profile; and transforming the decompressed transformed stress profile, with a second transformation, to form a decompressed stress profile, the second transformation being an inverse of the first transformation.

2. The method of claim 1, wherein the transforming of the stress profile, with a first transformation, comprises multiplying the stress profile by a first transformation matrix.

3. The method of claim 2, wherein the first transformation matrix is a discrete Fourier transform matrix.

4. The method of claim 2, wherein the first transformation matrix is a Hadamard matrix.

5. The method of claim 2, wherein the first transformation matrix is a unimodular matrix.

6. The method of claim 2, further comprising generating a number, wherein the first transformation matrix is:

a first matrix, when the number equals a first value, and a second matrix, different from the first matrix, when the number equals a second value.

7. The method of claim 6, wherein the second matrix is an identity matrix.

8. The method of claim 6, wherein the number is a pseudorandom number.

9. The method of claim 6, further comprising:

storing the compressed transformed stress profile in a memory, and storing the number in the memory.

10. A system for performing stress compensation in a display, the system comprising:

a memory; and a processing circuit configured to:

transform a stress profile for a slice of the display, with a first transformation, to form a transformed stress profile;

compress the transformed stress profile to form a compressed transformed stress profile;

decompress the compressed transformed stress profile to form a decompressed transformed stress profile; and transform the decompressed transformed stress profile, with a second transformation, to form a decompressed stress profile, the second transformation being an inverse of the first transformation.

11. The system of claim 10, wherein the transforming of the stress profile, with a first transformation, comprises multiplying the stress profile by a first transformation matrix.

12. The system of claim 11, wherein the first transformation matrix is a discrete Fourier transform matrix.

13. The system of claim 11, wherein the first transformation matrix is a Hadamard matrix.

14. The system of claim 11, wherein the first transformation matrix is a unimodular matrix.

15. The system of claim 11, wherein:

the processing circuit is further configured to generate a number, and the first transformation matrix is:

a first matrix, when the number equals a first value, and a second matrix, different from the first matrix, when the number equals a second value.

16. The system of claim 15, wherein the second matrix is an identity matrix.

17. The system of claim 15, wherein the number is a pseudorandom number.

18. The system of claim 15, wherein the processing circuit is further configured to:

store the compressed transformed stress profile in the memory, and store the number in the memory.

19. A display, comprising:

a display panel;

a memory; and a processing circuit configured to:

transform a stress profile for a slice of the display, with a first transformation, to form a transformed stress profile;

compress the transformed stress profile to form a compressed transformed stress profile;

decompress the compressed transformed stress profile to form a decompressed transformed stress profile; and transform the decompressed transformed stress profile, with a second transformation, to form a decompressed stress profile, the second transformation being an inverse of the first transformation.

20. The display of claim 19, wherein the first transformation is a discrete Fourier transform.

* * * * *